US010844801B2

(12) United States Patent
Yamamura et al.

(10) Patent No.: US 10,844,801 B2
(45) Date of Patent: Nov. 24, 2020

(54) ENGINE SYSTEM INCLUDING ELECTRONIC FUEL INJECTION CONTROL APPARATUS

(71) Applicant: HONDA MOTOR CO., LTD., Tokyo (JP)

(72) Inventors: Yoichi Yamamura, Wako (JP); Ryuichi Kimata, Tokyo (JP); Toshikazu Nakamura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 47 days.

(21) Appl. No.: 16/148,009

(22) Filed: Oct. 1, 2018

(65) Prior Publication Data

US 2019/0162126 A1 May 30, 2019

(30) Foreign Application Priority Data

Nov. 29, 2017 (JP) ..... 2017-229329

(51) Int. Cl.

| | |
|---|---|
| ***F02D 41/14*** | (2006.01) |
| ***F02D 41/30*** | (2006.01) |
| ***F02D 41/00*** | (2006.01) |
| ***F02B 63/04*** | (2006.01) |

(52) U.S. Cl.

CPC ..... *F02D 41/1441* (2013.01); *F02B 63/042* (2013.01); *F02D 41/0002* (2013.01); *F02D 41/1453* (2013.01); *F02D 41/1454* (2013.01); *F02D 41/1475* (2013.01); *F02D 41/3005* (2013.01); *F02D 41/1495* (2013.01)

(58) Field of Classification Search

CPC ..... F02D 41/1441; F02D 41/1475; F02D 41/1454; F02D 41/0002; F02D 41/3005; F02D 41/1453; F02D 41/1495; F02B 63/042

See application file for complete search history.

(56) References Cited

U.S. PATENT DOCUMENTS

| | | | | |
|---|---|---|---|---|
| 4,194,471 A * | 3/1980 | Baresel | ..... | F02D 41/1441 123/691 |
| 4,388,821 A * | 6/1983 | Martinez | ..... | G01M 15/104 73/1.06 |
| 5,309,777 A * | 5/1994 | Schmitt | ..... | G01N 33/0009 374/143 |
| 5,331,808 A * | 7/1994 | Koike | ..... | F02D 41/1441 123/688 |

(Continued)

FOREIGN PATENT DOCUMENTS

| | | |
|---|---|---|
| JP | 2001-215205 A | 8/2001 |
| JP | 2004-069457 A | 3/2004 |

*Primary Examiner* — Joseph J Dallo

*Assistant Examiner* — Kurt Philip Liethen

(74) *Attorney, Agent, or Firm* — Thomas Horstemeyer, LLP

(57) ABSTRACT

A fuel injection control apparatus is provided. An injection unit injects fuel in an internal combustion engine. A carbon monoxide concentration sensor is provided in an exhaust path of the internal combustion engine and detects a carbon monoxide concentration in an exhaust gas. A control unit controls the injection unit based on the carbon monoxide concentration detected by the carbon monoxide concentration sensor such that an air fuel ratio in the internal combustion engine becomes close to a target air fuel ratio.

4 Claims, 4 Drawing Sheets

(56) References Cited

U.S. PATENT DOCUMENTS

| | | | | |
|---|---|---|---|---|
| 6,374,818 | B2 | 4/2002 | Shinjyo et al. | |
| 6,428,684 | B1 * | 8/2002 | Warburton | G01N 27/4163 204/401 |
| 7,285,204 | B2 | 10/2007 | Iida et al. | |
| 2003/0029426 | A1 * | 2/2003 | Surnilla | F02D 41/065 123/685 |
| 2004/0144079 | A1 * | 7/2004 | Nagai | F02D 41/1455 60/276 |
| 2008/0196489 | A1 * | 8/2008 | Fukagai | F02D 41/1454 73/114.72 |
| 2008/0264036 | A1 * | 10/2008 | Bellovary | F01N 3/00 60/274 |
| 2010/0083935 | A1 * | 4/2010 | Murase | F02D 41/008 123/406.12 |
| 2015/0167600 | A1 * | 6/2015 | Kawamura | F02M 69/046 123/445 |
| 2015/0233316 | A1 * | 8/2015 | Kumar | F02D 41/1495 123/703 |

* cited by examiner

ENGINE SYSTEM INCLUDING ELECTRONIC FUEL INJECTION CONTROL APPARATUS

BACKGROUND OF THE INVENTION

Field of the Invention

The present invention relates to an electronic fuel injection control apparatus and an engine system.

Description of the Related Art

An internal combustion engine used in a motorcycle or a generator includes an oxygen concentration sensor ($O_2$ sensor). An engine control unit detects the oxygen concentration in an exhaust gas by the $O_2$ sensor, obtains an air fuel ratio (A/F ratio) from the detected oxygen concentration, and adjusts the injection amount (supply amount) of fuel such that the air fuel ratio becomes a predetermined value (example: theoretical air fuel ratio). Each of Japanese Patent Laid-Open No. 2001-215205 and Japanese Patent Laid-Open No. 2004-069457 describes such an $O_2$ sensor.

As shown in Japanese Patent Laid-Open No. 2001-215205 and Japanese Patent Laid-Open No. 2004-069457, conventionally, control concerning the air fuel ratio is executed using the $O_2$ sensor. However, a general $O_2$ sensor is a sensor that is turned on when the oxygen concentration in the exhaust gas is a predetermined value or more and turned off when the oxygen concentration is less than the predetermined value and, therefore, a correct oxygen concentration cannot be known. A four-wheel vehicle can employ a linear AF sensor capable of linearly detecting the air fuel ratio. However, the linear AF sensor is too expensive for the internal combustion engine used in the motorcycle or generator.

SUMMARY OF THE INVENTION

The present invention provides a fuel injection control apparatus comprising: an injection unit configured to inject fuel in an internal combustion engine; a carbon monoxide concentration sensor provided in an exhaust path of the internal combustion engine and configured to detect a carbon monoxide concentration in an exhaust gas; and a control unit configured to control the injection unit based on the carbon monoxide concentration detected by the carbon monoxide concentration sensor such that an air fuel ratio in the internal combustion engine becomes close to a target air fuel ratio.

Further features of the present invention will become apparent from the following description of exemplary embodiments with reference to the attached drawings.

DESCRIPTION OF THE EMBODIMENTS

<Engine System>

Figure 1:
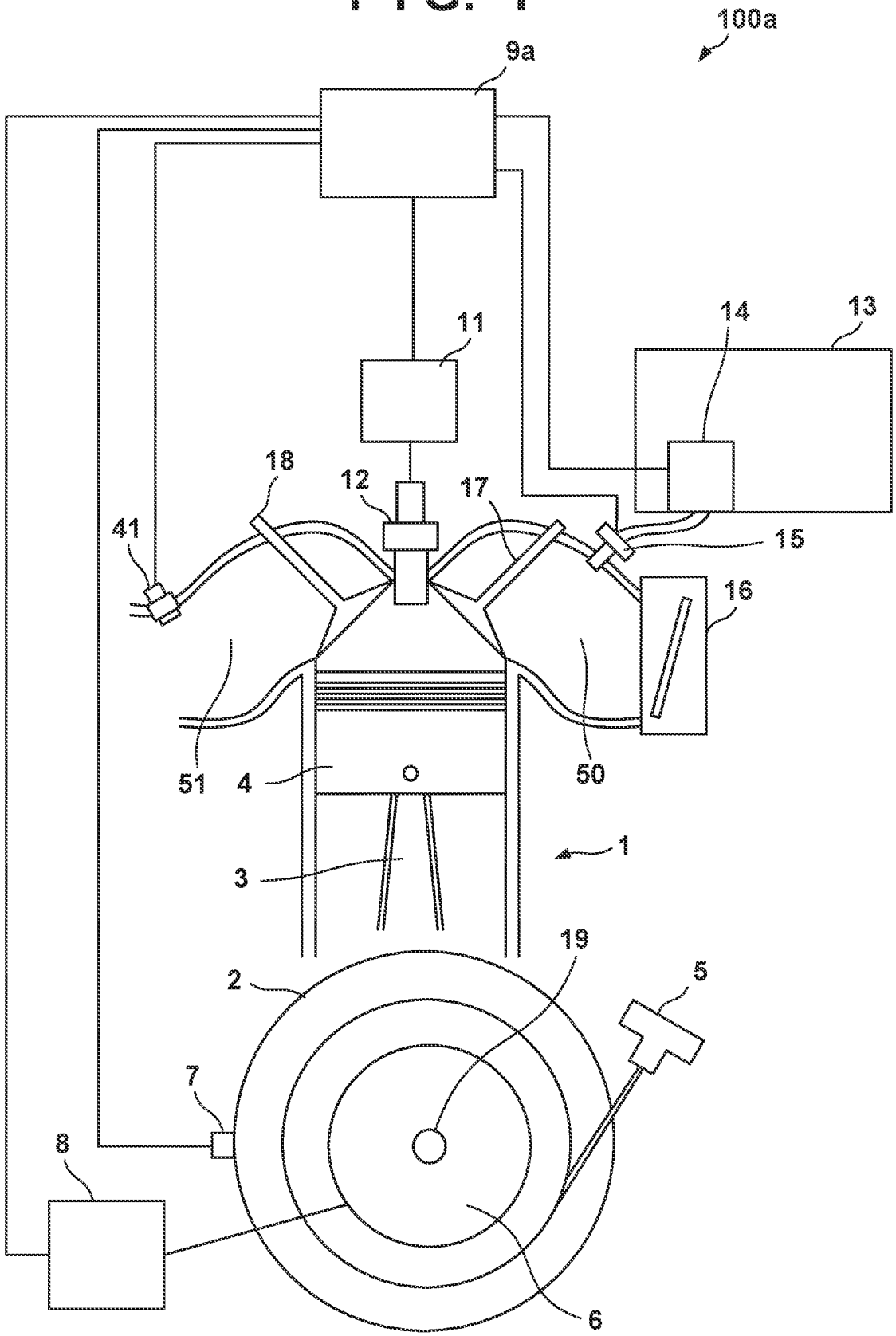
FIG. 1 is a schematic view showing an engine system.

FIG. 1 is a schematic view showing an engine system 100*a*. The engine system 100*a* may be called an electronic fuel injection control system. An internal combustion engine 1 is a 4-stroke engine. A crankshaft 19 is stored in a crankcase 2. When the crankshaft 19 rotates, a piston 4 connected to a connecting rod 3 moves in the vertical direction in a cylinder. A recoil starter 5 used to start the internal combustion engine 1 is connected to the crankshaft 19. A recoil operator grasps and pulls the handle of the recoil starter 5, thereby rotating the crankshaft 19. Note that a starter motor that rotates upon receiving power supplied from a battery may be employed as a starter in place of the recoil starter 5. A generator 6 is connected to the crankshaft 19. When the crankshaft 19 rotates, the rotor of the generator 6 rotates and generates power. The crank angle of the crankshaft 19 is detected by a crank angle sensor 7. The crank angle sensor 7 may be, for example, a Hall element configured to detect the magnetism of a magnet provided on a flywheel connected to the crankshaft 19. The power supply circuit 8 includes an inverter that converts an AC generated by the generator 6 into an AC of a predetermined frequency, a circuit that converts the AC into a DC, a circuit that converts the level of the DC voltage, and the like. The power supply circuit 8 supplies the power generated by the generator 6 to a control unit 9*a*. Note that when the crankshaft 19 is rotated by the recoil starter 5, the generator 6 generates sufficient power for the control unit 9*a* to operate. The control unit 9*a* is an engine control unit (ECU) and controls the power supplied from the power supply circuit 8 to an ignition device 11, a fuel pump 14, an injector 15, a throttle motor 16, and the like. The ignition device 11 supplies ignition power to cause a spark plug 12 to cause spark discharge. A fuel tank 13 is a container that stores fuel. The fuel pump 14 is a pump that supplies fuel stored in the fuel tank 13 to the injector 15. Referring to FIG. 1, the fuel pump 14 is provided in the fuel tank. The throttle motor 16 is a motor configured to control the inflow amount of air flowing into the cylinder via an intake path 50. An intake valve 17 is a valve to be opened/closed by a cam configured to convert the rotary motion of the crankshaft 19 into a vertical motion, and the like. The intake valve 17 is opened in the intake stroke and is basically closed in a compression stroke, an expansion stroke, and an exhaust stroke. An exhaust valve 18 is a valve to be opened/closed by a cam configured to convert the rotary motion of the crankshaft 19 into a vertical motion, and the like. The exhaust valve 18 is opened in the exhaust stroke and is basically closed in the compression stroke, the expansion stroke, and the intake stroke. For smooth transition from exhaust to intake, a period in which the intake valve 17 and the exhaust valve 18 are simultaneously opened may be provided (overlap). A CO sensor 41 is a sensor that detects a carbon monoxide (CO) concentration in an exhaust gas discharged from the cylinder to an exhaust path 51.

<Control Unit and Power Supply Circuit>

Figure 2:
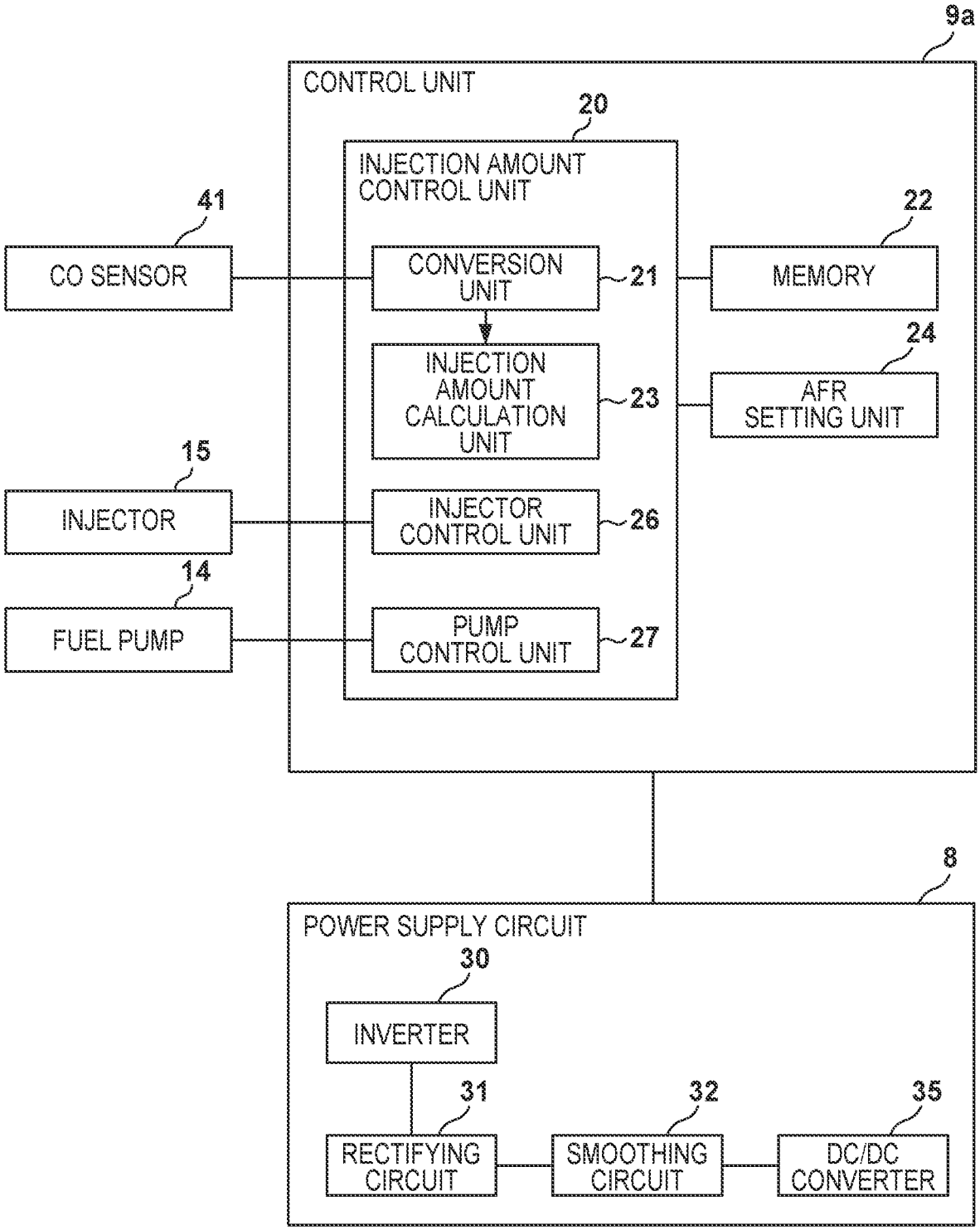
FIG. 2 is a block diagram showing a control unit and a power supply circuit.

FIG. 2 shows the function of the control unit 9*a* and the function of the power supply circuit 8. In the control unit 9*a*, an injection amount control unit 20 controls the injector 15 or the fuel pump 14 based on the carbon monoxide concentration detected by the CO sensor 41 such that the air fuel ratio in the internal combustion engine 1 becomes close to a target air fuel ratio. A conversion unit 21 converts the carbon monoxide concentration detected by the CO sensor 41 into an air fuel ratio (A/F ratio). For example, the conversion unit 21 converts the carbon monoxide concentration into the air fuel ratio using a conversion table stored in a memory 22 or a conversion function (equation). The air fuel ratio and the carbon monoxide concentration in the exhaust gas have a correlation. In particular, in a state in which the fuel in the exhaust gas is rich, the carbon monoxide concentration is in inverse proportion to the air fuel ratio. On the other hand, the CO sensor 41 outputs a voltage (detection signal) correlated with the carbon monoxide concentration in the exhaust gas. Hence, the air fuel ratio can be calculated from the carbon monoxide concentration in the exhaust gas. The memory 22 is a storage device including a RAM, a ROM, and the like. An AFR setting unit 24 decides a target air fuel ratio in accordance with the temperature of the internal combustion engine 1, the load of the generator 6, and the like and sets it in an injection amount calculation unit 23. The injection amount calculation unit 23 calculates the fuel injection amount such that the air fuel ratio acquired by the conversion unit 21 becomes close to the target air fuel ratio. For example, the injection amount calculation unit 23 calculates the fuel injection amount in accordance with the difference (feedback amount) between the target air fuel ratio and the air fuel ratio acquired by the conversion unit 21. The injection amount calculation unit 23 sets a fuel supply amount according to the fuel injection amount in a pump control unit 27. The pump control unit 27 supplies fuel according to the fuel supply amount to the injector 15. An injector control unit 26 causes the injector 15 to inject the fuel at an injection timing decided in accordance with the crank angle.

In the power supply circuit 8, an inverter 30 is a conversion circuit that converts an AC generated by the generator 6 into an AC of a predetermined frequency. A rectifying circuit 31 is a circuit that rectifies the AC generated by the AC generated by the generator 6. A smoothing circuit 32 is a circuit that generates a DC by smoothing the pulsating current generated by the rectifying circuit 31. Accordingly, a DC voltage of, for example, 12 V is generated. The control unit 9*a* may PWM-control the power supplied to the fuel pump 14 in accordance with the load of the generator 6 or the internal combustion engine 1. A DC/DC converter 35 is a circuit that converts the level of the DC voltage. For example, the DC/DC converter 35 converts the DC voltage of 12 V into a DC voltage of 5 V or 3.3 V.

<Another Engine System>

Figure 3:
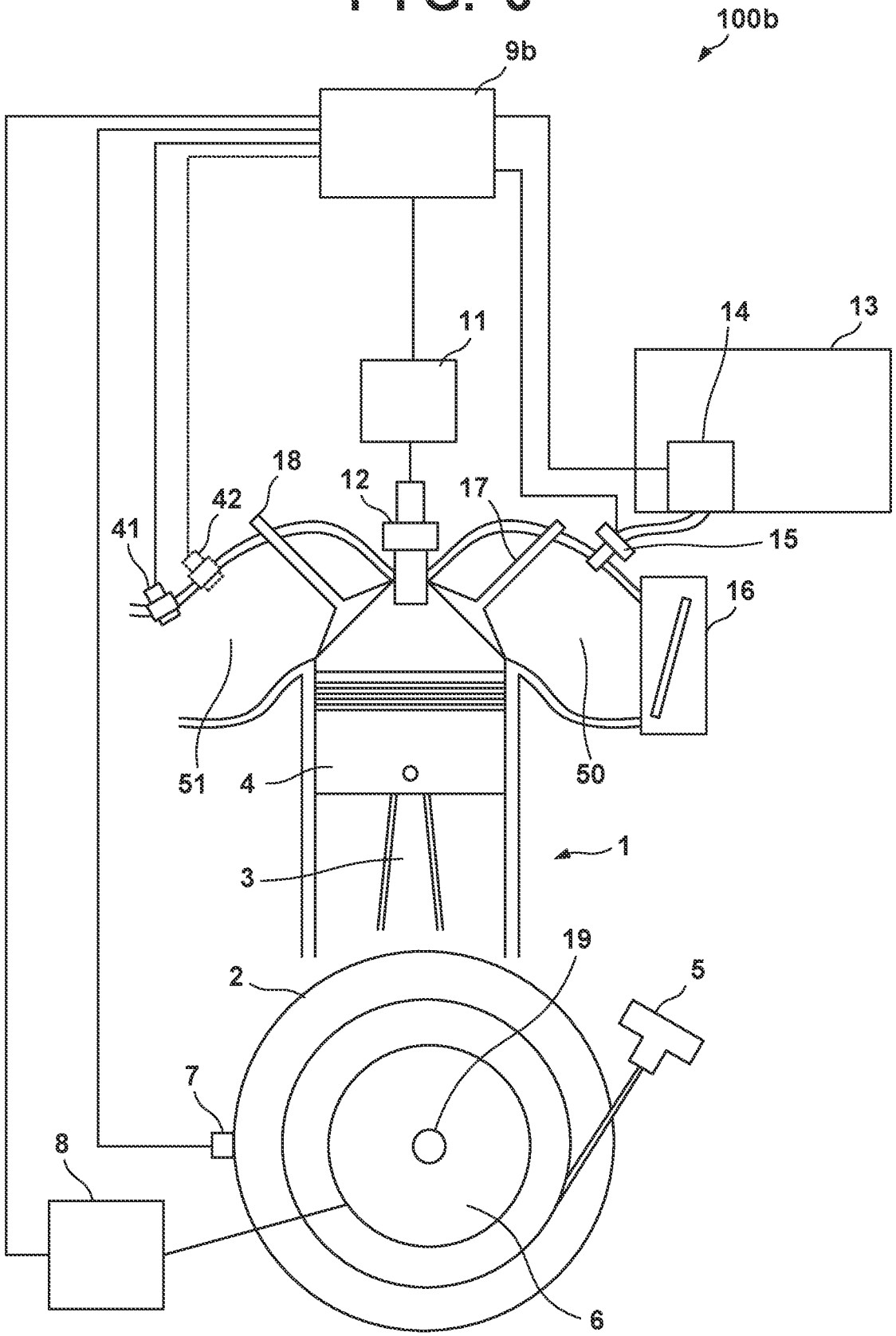
FIG. 3 is a schematic view showing an engine system.

FIG. 3 is a schematic view showing an engine system 100*b*. The same reference numerals as in the first embodiment denote the common or similar parts in the second embodiment. In the engine system 100*b*, an $O_2$ sensor 42 is added to the engine system 100*a*. The $O_2$ sensor 42 is an oxygen concentration sensor that is provided in an exhaust path 51 of an internal combustion engine 1 and detects the oxygen concentration in the exhaust gas. The $O_2$ sensor 42 is used to determine whether the mixture of fuel and air is in a rich state or a lean state.

<Control Unit and Power Supply Circuit>

Figure 4:
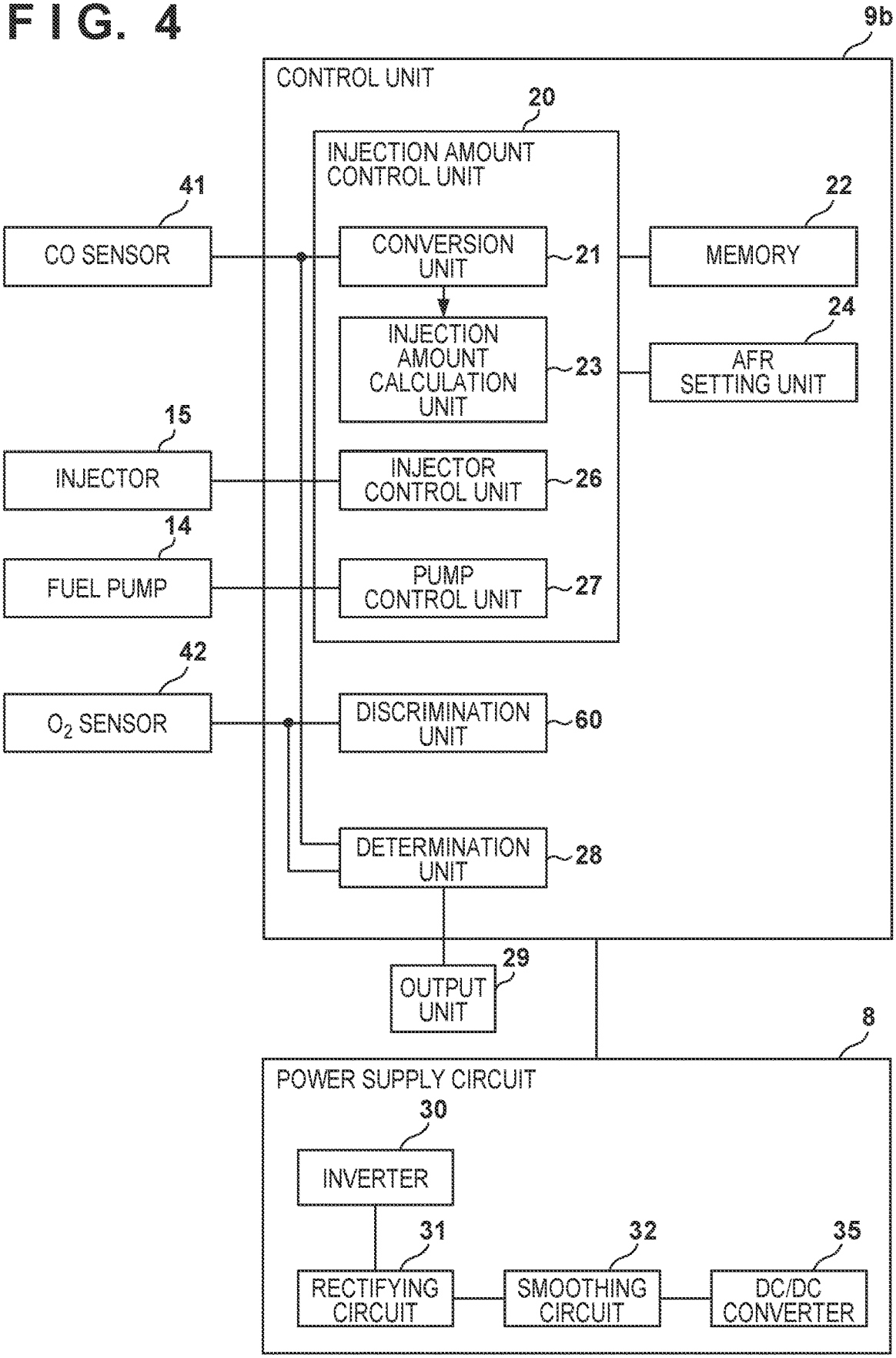
FIG. 4 is a block diagram showing a control unit and a power supply circuit.

FIG. 4 shows the function of a control unit 9*b* and the function of a power supply circuit 8. In the control unit 9*b*, a determination unit 28, a discrimination unit 60, and an output unit 29 are added to the control unit 9*a*. The discrimination unit 60 discriminates, based on the oxygen concentration detected by the $O_2$ sensor 42, between the rich state in which the air fuel ratio is lower than the theoretical air fuel ratio and the lean state in which the air fuel ratio is higher than the theoretical air fuel ratio. The injection amount control unit 20 may execute stoichiometric control for controlling a fuel pump 14 or an injector 15 in accordance with the discrimination result of the discrimination unit 60. Stoichiometric control is control performed to maintain the air fuel ratio of the mixture at the theoretical air fuel ratio.

The determination unit 28 determines a fault of the $O_2$ sensor 42 based on a detection signal output from the $O_2$ sensor 42 in accordance with the oxygen concentration in the exhaust gas and a detection signal output from a CO sensor 41 in accordance with the carbon monoxide concentration in the exhaust gas. The level of the detection signal output from the $O_2$ sensor 42 and the level of the detection signal output from the CO sensor 41 change in synchronism. Hence, if the level of the detection signal output from the $O_2$ sensor 42 and the level of the detection signal output from the CO sensor 41 do not synchronize, the determination unit 28 determines that one of the CO sensor 41 and the $O_2$ sensor 42 has a fault and causes the output unit 29 to output a fault notification. The output unit 29 may be a light-emitting diode or a buzzer or may be a liquid crystal display device or the like. This allows the user to readily recognize the fault of the sensor.

Note that the discrimination unit 60 may be provided inside the $O_2$ sensor 42. In this case, the $O_2$ sensor 42 outputs a detection signal of high level in the rich state and outputs a detection signal of low level in the lean state. The determination unit 28 can compare the theoretical air fuel ratio and the air fuel ratio output from a conversion unit 21 and identify whether the air fuel ratio obtained using the CO sensor 41 is in the rich state or the lean state. Hence, if the rich/lean state detected by the $O_2$ sensor 42 and the rich/lean state detected by the CO sensor 41 match, the determination unit 28 determines that the CO sensor 41 and the $O_2$ sensor 42 do not have a fault. If the rich/lean state detected by the $O_2$ sensor 42 and the rich/lean state detected by the CO sensor 41 do not match, the determination unit 28 determines that one of the CO sensor 41 and the 02 sensor 42 has a fault.

<Summary>

In the first and second embodiments, the control units 9*a* and 9*b* are an example of a fuel injection control apparatus. The fuel pump 14 and the injector 15 are an example of an injection unit (fuel supply unit) configured to inject fuel in the internal combustion engine 1. The CO sensor 41 is an example of a carbon monoxide concentration sensor provided in the exhaust path 51 of the internal combustion engine 1 and configured to detect a carbon monoxide concentration in an exhaust gas. The injection amount control unit 20 is an example of a control unit configured to control the injection unit based on the carbon monoxide concentration detected by the carbon monoxide concentration sensor such that an air fuel ratio in the internal combustion engine 1 becomes close to a target air fuel ratio. As described above, in the first and second embodiments, control concerning the air fuel ratio can be executed using the CO sensor 41. The CO sensor 41 is inexpensive as compared to a linear AF sensor. For this reason, the A/F ratio is accurately detected even in the internal combustion engine 1 for a motorcycle, an engine generator, or an agricultural working machine. In addition, control concerning the A/F ratio can be implemented at low cost. Note that placing focus on the correlation between the air fuel ratio and the carbon monoxide concentration, the fuel pump 14 and the injector 15 may be controlled such that the carbon monoxide concentration detected by the CO sensor 41 becomes the carbon monoxide concentration at the target air fuel ratio. That is, the fuel injection amount (fuel supply amount) may be controlled based on the carbon monoxide concentration detected by the CO sensor 41.

The conversion unit 21 is an example of a conversion unit configured to convert the carbon monoxide concentration detected by the carbon monoxide concentration sensor into the air fuel ratio. The injection amount control unit 20 may control the injection unit such that the air fuel ratio acquired by the conversion unit 21 becomes close to the target air fuel ratio.

As shown in the second embodiment, the $O_2$ sensor 42 is an example of an oxygen concentration sensor provided in the exhaust path 51 of the internal combustion engine 1 and configured to detect an oxygen concentration in the exhaust gas. The discrimination unit 60 may discriminate, based on the oxygen concentration detected by the oxygen concentration sensor, between a rich state in which the air fuel ratio is lower than a theoretical air fuel ratio and a lean state in which the air fuel ratio is higher than the theoretical air fuel ratio. The injection amount control unit 20 may control the injection unit such that the air fuel ratio acquired by the conversion unit 21 becomes close to the target air fuel ratio in the rich state. The injection amount control unit 20 may also control the injection unit such that the air fuel ratio acquired by the conversion unit 21 becomes close to the target air fuel ratio in the lean state.

The $O_2$ sensor 42 may be an oxygen concentration sensor provided in the exhaust path 51 of the internal combustion engine 1 and configured to output, based on an oxygen concentration in the exhaust gas, one of a detection signal representing a rich state in which the air fuel ratio of the internal combustion engine 1 is lower than a theoretical air fuel ratio and a detection signal representing a lean state in which the air fuel ratio is higher than the theoretical air fuel ratio. The injection amount control unit 20 may control the injection unit such that the air fuel ratio acquired by the conversion unit 21 becomes close to the target air fuel ratio when the oxygen concentration sensor outputs the detection signal representing the rich state.

The determination unit 28 is an example of a determination unit configured to determine a fault of one of the carbon monoxide concentration sensor and the oxygen concentration sensor based on a detection signal output from the oxygen concentration sensor and a detection signal output from the carbon monoxide concentration sensor in accordance with the carbon monoxide concentration in the exhaust gas. The output unit 29 is an example of an output unit configured to output a notification when the determination unit determines that one of the carbon monoxide concentration sensor and the oxygen concentration sensor has the fault. This allows the user to easily know the fault of the sensor.

Note that the fuel injection control apparatus may include an injection unit configured to inject fuel in the internal combustion engine 1, an adjustment unit configured to adjust the inflow amount of air in the intake path of the internal combustion engine 1, an oxygen concentration sensor provided in the exhaust path 51 of the internal combustion engine 1 and configured to detect an oxygen concentration in an exhaust gas, a carbon monoxide concentration sensor provided in the exhaust path 51 and configured to detect a carbon monoxide concentration in the exhaust gas, a discrimination unit configured to discriminate, based on the oxygen concentration detected by the oxygen concentration sensor, between a rich state in which an air fuel ratio is lower than a theoretical air fuel ratio and a lean state in which the air fuel ratio is higher than the theoretical air fuel ratio, a conversion unit configured to convert the carbon monoxide concentration detected by the carbon monoxide concentration sensor into the air fuel ratio, and a control unit configured to control the injection unit such that the air fuel ratio acquired by the conversion unit becomes close to a target air fuel ratio in the rich state and control the adjustment unit in accordance with a load of the internal combustion engine 1. Here, the throttle motor 16 is an example of the adjustment unit configured to adjust the inflow amount of air in the intake path of the internal combustion engine 1.

An engine system 100 may include the fuel tank 13 configured to store fuel, the internal combustion engine 1, a throttle (throttle motor 16) configured to adjust the inflow amount of air in the intake path 50 of the internal combustion engine 1, a carbon monoxide concentration sensor provided in the exhaust path 51 of the internal combustion engine 1 and configured to detect a carbon monoxide concentration in an exhaust gas, the generator 6 driven by the internal combustion engine 1 and configured to generate power, the injector 15 operated by the power generated by the generator 6 and configured to supply the fuel to the internal combustion engine 1, the fuel pump 14 operated by the power generated by the generator 6 and configured to supply the fuel stored in the fuel tank 13 to the injector 15, the ignition device 11 configured to ignite the fuel compressed in the internal combustion engine 1, and the control unit 9*a* or 9*b* operated by the power generated by the generator 6 and configured to control the fuel pump and the injector based on the carbon monoxide concentration detected by the carbon monoxide concentration sensor such that an air fuel ratio in the internal combustion engine 1 becomes close to a target air fuel ratio.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-229329, filed Nov. 29, 2017, which is hereby incorporated by reference herein in its entirety.

What is claimed is:

1. A fuel injection control apparatus comprising:

a fuel injector configured to inject fuel in an internal combustion engine;

a carbon monoxide concentration sensor provided in an exhaust path of the internal combustion engine and configured to detect a carbon monoxide concentration in an exhaust gas, the carbon monoxide concentration sensor being located at an upstream side of an end of the exhaust path in a direction of the exhaust gas;

an oxygen concentration sensor provided in the exhaust path of the internal combustion engine and configured to detect an oxygen concentration in the exhaust gas, the oxygen concentration sensor being located at an upstream side of the end of the exhaust path in the direction of the exhaust gas;

an engine control unit (ECU) configured to:

convert the carbon monoxide concentration detected by the carbon monoxide concentration sensor into the air fuel ratio;

discriminate, based on the oxygen concentration detected by the oxygen concentration sensor, between a rich state in which the air fuel ratio is lower than a theoretical air fuel ratio and a lean state in which the air fuel ratio is higher than the theoretical air fuel ratio;

control the fuel injector while the ECU is discriminating that the exhaust gas is in the rich state such that an air fuel ratio converted from the detected carbon monoxide concentration in the internal combustion engine becomes close to a target air fuel ratio; and determine a fault of the carbon monoxide concentration sensor or a fault of the carbon monoxide concentration sensor and the oxygen concentration sensor by comparing a detection signal output from the oxygen concentration sensor and a detection signal output from the carbon monoxide concentration sensor in accordance with the carbon monoxide concentration in the exhaust gas; and an output unit configured to output a notification when the ECU determines that the carbon monoxide concentration sensor and/or the oxygen concentration sensor has the fault.

2. The apparatus according to claim 1, wherein the oxygen concentration sensor is further configured to output, based on an oxygen concentration in the exhaust gas, one of a detection signal representing a rich state in which the air fuel ratio of the internal combustion engine is lower than a theoretical air fuel ratio and a detection signal representing a lean state in which the air fuel ratio is higher than the theoretical air fuel ratio, wherein the ECU further is configured to control the fuel injector such that the air fuel ratio converted from the detected carbon monoxide concentration becomes close to the target air fuel ratio when the oxygen concentration sensor outputs the detection signal representing the rich state.

3. A fuel injection control apparatus comprising:

a fuel injector configured to inject fuel in an internal combustion engine;

a throttle motor configured to adjust an inflow amount of air in an intake path of the internal combustion engine;

an oxygen concentration sensor provided in an exhaust path of the internal combustion engine and configured to detect an oxygen concentration in an exhaust gas, the oxygen concentration sensor being located at an upstream side of the end of the exhaust path in the direction of the exhaust gas;

a carbon monoxide concentration sensor provided in the exhaust path and configured to detect a carbon monoxide concentration in the exhaust gas, the carbon monoxide concentration sensor being located at an upstream side of the end of the exhaust path in a direction of the exhaust gas;

an engine control unit (ECU) configured to:

discriminate, based on the oxygen concentration detected by the oxygen concentration sensor, between a rich state in which an air fuel ratio is lower than a theoretical air fuel ratio and a lean state in which the air fuel ratio is higher than the theoretical air fuel ratio;

convert the carbon monoxide concentration detected by the carbon monoxide concentration sensor into the air fuel ratio;

control the fuel injector such that the air fuel ratio converted from the detected carbon monoxide concentration becomes close to a target air fuel ratio in the rich state and control the throttle motor in accordance with a load of the internal combustion engine while the ECU is discriminating that the exhaust gas is in the rich state; and determine a fault of the carbon monoxide concentration sensor or a fault of the carbon monoxide concentration sensor and the oxygen concentration sensor by comparing a detection signal output from the oxygen concentration sensor and a detection signal output from the carbon monoxide concentration sensor in accordance with the carbon monoxide concentration in the exhaust gas; and an output unit configured to output a notification when the ECU determines that the carbon monoxide concentration sensor and/or the oxygen concentration sensor has the fault.

4. An engine system comprising:

a fuel tank configured to store fuel;

an internal combustion engine;

a throttle configured to adjust an inflow amount of air in an intake path of the internal combustion engine;

a carbon monoxide concentration sensor provided in an exhaust path of the internal combustion engine and configured to detect a carbon monoxide concentration in an exhaust gas, the carbon monoxide concentration sensor being located at an upstream side of an end of the exhaust path in a direction of the exhaust gas;

an oxygen concentration sensor provided in the exhaust path of the internal combustion engine and configured to detect an oxygen concentration in the exhaust gas, the oxygen concentration sensor being located at an upstream side of the end of the exhaust path in the direction of the exhaust gas;

a generator driven by the internal combustion engine and configured to generate power;

an injector operated by the power generated by the generator and configured to supply the fuel to the internal combustion engine;

a fuel pump operated by the power generated by the generator and configured to supply the fuel stored in the fuel tank to the injector;

an ignition device configured to ignite the fuel compressed in the internal combustion engine;

an engine control unit (ECU) operated by the power generated by the generator and configured to control the fuel pump and the injector; and an output unit, wherein the ECU is further configured to:

convert the carbon monoxide concentration detected by the carbon monoxide concentration sensor into the air fuel ratio;

discriminate, based on the oxygen concentration detected by the oxygen concentration sensor, between a rich state in which the air fuel ratio is lower than a theoretical air fuel ratio and a lean state in which the air fuel ratio is higher than the theoretical air fuel ratio;

control the fuel pump and the injector such that the air fuel ratio converted from the detected carbon monoxide concentration becomes close to a target air fuel ratio while the ECU is discriminating that the exhaust gas is in the rich state; and determine a fault of the carbon monoxide concentration sensor or a fault of the carbon monoxide concentration sensor and the oxygen concentration sensor by comparing a detection signal output from the oxygen concentration sensor and a detection signal output from the carbon monoxide concentration sensor in accordance with the carbon monoxide concentration in the exhaust gas; and wherein the output unit is further configured to output a notification when the ECU determines that the carbon monoxide concentration sensor and/or the oxygen concentration sensor has the fault.

* * * * *